US011525598B2

(12) United States Patent
Takenaka et al.

(10) Patent No.: US 11,525,598 B2
(45) Date of Patent: Dec. 13, 2022

(54) AIR-CONDITIONING APPARATUS

(71) Applicant: Mitsubishi Electric Corporation, Tokyo (JP)

(72) Inventors: Naofumi Takenaka, Tokyo (JP); Kimitaka Kadowaki, Tokyo (JP); Hiroki Washiyama, Tokyo (JP); Yuji Motomura, Tokyo (JP); Koji Furuya, Tokyo (JP); Jun Nishio, Tokyo (JP); Koji Azuma, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 17/262,891

(22) PCT Filed: Sep. 28, 2018

(86) PCT No.: PCT/JP2018/036576
§ 371 (c)(1),
(2) Date: Jan. 25, 2021

(87) PCT Pub. No.: WO2020/066016
PCT Pub. Date: Apr. 2, 2020

(65) Prior Publication Data

US 2021/0164684 A1 Jun. 3, 2021

(51) Int. Cl.
*F24F 11/52* (2018.01)
*F24F 11/84* (2018.01)

(52) U.S. Cl.
CPC ..... *F24F 11/84* (2018.01); *F24F 11/52* (2018.01)

(58) Field of Classification Search
CPC ..... F24F 11/84; F24F 11/52
See application file for complete search history.

(56) References Cited

FOREIGN PATENT DOCUMENTS

| | | |
|---|---|---|
| JP | 2009-139014 A | 6/2009 |
| JP | 2014-035092 A | 2/2014 |

OTHER PUBLICATIONS

International Search Report of the International Searching Authority dated Nov. 13, 2018 for the corresponding International application No. PCT/JP2018/036576 (and English translation).

*Primary Examiner* — Nael N Babaa
(74) *Attorney, Agent, or Firm* — Posz Law Group, PLC

(57) ABSTRACT

An air-conditioning apparatus includes: a heat-medium transfer device including a pump provided to transfer a heat medium that contains water or brine and transfers heat; a plurality of indoor units each of which includes an indoor heat exchanger provided to cause heat exchange to be performed between indoor air and the heat medium, and a flow control valve provided to adjust a flow rate of the heat medium that flows through the indoor heat exchanger, the plurality of indoor units being connected to the heat-medium transfer device by respective heat medium pipes; and a controller provided to control an opening degree of the flow control valve. The controller determines a valve opening-degree control range that is a control range of an opening degree of the flow control valve of each indoor unit, based on a flow-passage resistance depending on a length of a pipe that extends from the heat-medium transfer device to the indoor unit, such that the lower the flow-passage resistance, the smaller the valve opening-degree control range.

8 Claims, 5 Drawing Sheets

FIG. 7

| A_rank | PRESSURE LOSS $dPa_k$[kPa] |
|---|---|
| 0 | LESS THAN 5 |
| 1 | 5 TO LESS THAN 15 |
| 2 | 15 TO LESS THAN 25 |
| 3 | 25 TO LESS THAN 35 |
| 4 | 35 TO LESS THAN 45 |
| 5 | 45 TO LESS THAN 55 |
| 6 | 55 TO LESS THAN 65 |
| 7 | 65 TO LESS THAN 75 |
| 8 | 75 TO LESS THAN 85 |
| 9 | 85 TO LESS THAN 95 |
| 10 | 95 OR MORE |

FIG. 8

| B_rank | PRESSURE LOSS $dPb_k$[kPa] |
|---|---|
| 0 | LESS THAN 5 |
| 1 | 5 TO LESS THAN 15 |
| 2 | 15 TO LESS THAN 25 |
| 3 | 25 TO LESS THAN 35 |
| 4 | 35 TO LESS THAN 45 |
| 5 | 45 TO LESS THAN 55 |
| 6 | 55 TO LESS THAN 65 |
| 7 | 65 TO LESS THAN 75 |
| 8 | 75 TO LESS THAN 85 |
| 9 | 85 TO LESS THAN 95 |
| 10 | 95 OR MORE |

AIR-CONDITIONING APPARATUS

CROSS REFERENCE TO RELATED APPLICATION

This application is a U.S. national stage application of PCT/JP2018/036576 filed on Sep. 28, 2018, the contents of which are incorporated herein by reference.

TECHNICAL FIELD

The present disclosure relates to an air-conditioning apparatus that circulates a heat medium to perform air conditioning.

BACKGROUND ART

In the part, direct expansion air-conditioning apparatuses have been used in which an outdoor unit and an indoor unit are connected, and refrigerant is circulated between the outdoor unit and the indoor unit to condition air in an indoor space that is an air-conditioned space (see, for example, Patent Literature 1). in a direct expansion air-conditioning apparatus disclosed in Patent Literature 1, under normal conditions, a capacity control is performed using the degree of superheat SH during a cooling operation, and is performed using the degree of subcooling SC during a heating operation. Therefore, regardless of the distance from the outdoor unit to the indoor unit, the flow rate of refrigerant to be supplied to the indoor unit is controlled depending on a heat exchange capacity of the indoor unit that is determined in advance in design.

On the other hand, a given air-conditioning system includes a primary cycle circuit that includes a compressor, an outdoor heat exchanger, an expansion device, and an intermediate heat exchanger, and that generates heat through an vapor compression refrigeration cycle circuit, and a secondary cycle circuit that includes a heat-medium transfer unit and an indoor heat exchanger for the secondary cycle circuit, such as an intermediate heat exchanger and a pump, and that transfers heat using a heat medium such as water or brine. As an example of such an air-conditioning system, an air-conditioning system including a heat source unit and an indoor unit is present. As another example of the above air-conditioning system, an air-conditioning system including a heat source unit (outdoor unit), a relay unit, and a plurality of indoor units is present. In this air-conditioning system, between the outdoor unit and the relay unit, heat is transferred using refrigerant; in the relay unit, heat exchange is performed between the refrigerant and a heat medium such as water; and between the relay unit and the indoor units, heat is transferred using the heat medium.

CITATION LIST

Patent Literature

Patent Literature 1: Japanese Unexamined Patent Application Publication No. 2009-139014

SUMMARY OF INVENTION

Technical Problem

In an air-conditioning apparatus using a heat medium, if pipes that extend from a relay unit to a plurality of indoor units have different lengths, pressure losses in the pipes are also different from each other. Consequently, a drift occurs in heat mediums for the respective indoor units, and the flow rates of the heat mediums in the indoor units are different from each other. To be more specific, the capacity of an indoor unit that is located far from the relay unit is greatly lower than that of an indoor unit that is located close to the indoor unit. In such a manner, in existing air-conditioning apparatuses, if the lengths of pipes from the relay unit to indoor units are different from each other, the capacities of the indoor units are also different from each other; that is, how the indoor space is easily heated or cooled varies from one indoor unit from another.

The present disclosure is applied to solve the above problem, and relates to an air-conditioning apparatus in which even in the case where lengths of pipes connected to indoor units are different from each other, the difference between the capacities of the indoor units can be eliminated.

Solution to Problem

An air-conditioning apparatus according to an embodiment of the present disclosure includes: a heat-medium transfer device including a pump provided to transfer a heat medium that contains water or brine and transfers heat; a plurality of indoor units each of which includes an indoor heat exchanger provided to cause heat exchange to be performed between indoor air and the heat medium, and a flow control valve provided to adjust a flow rate of the heat medium that flows through the indoor heat exchanger, the plurality of indoor units being connected to the heat-medium transfer device by respective heat medium pipes; and a controller provided to control an opening degree of the flow control valve. The controller determines a valve opening-degree control range that is a control range of an opening degree of the flow control valve of each indoor unit, based on a flow-passage resistance depending on a length of a pipe that extends from the heat-medium transfer device to the indoor unit, such that the lower the flow-passage resistance, the smaller the valve opening-degree control range.

Advantageous Effects of Invention

According to the embodiment of the present disclosure, with respect to each of the indoor units, the opening-degree control range of the flow control valve is determined depending on the length of the heat medium pipe connected to the indoor unit. Thus, even in the case where the pipes connected to the indoor units have different lengths, the difference between the capacities of the indoor units can be eliminated.

BRIEF DESCRIPTION OF DRAWINGS

FIG. 7 is a schematic view showing an example of a first rank table.

FIG. 8 is a schematic view showing an example of a second rank table.

DESCRIPTION OF EMBODIMENTS

Embodiment 1

Figure 1:
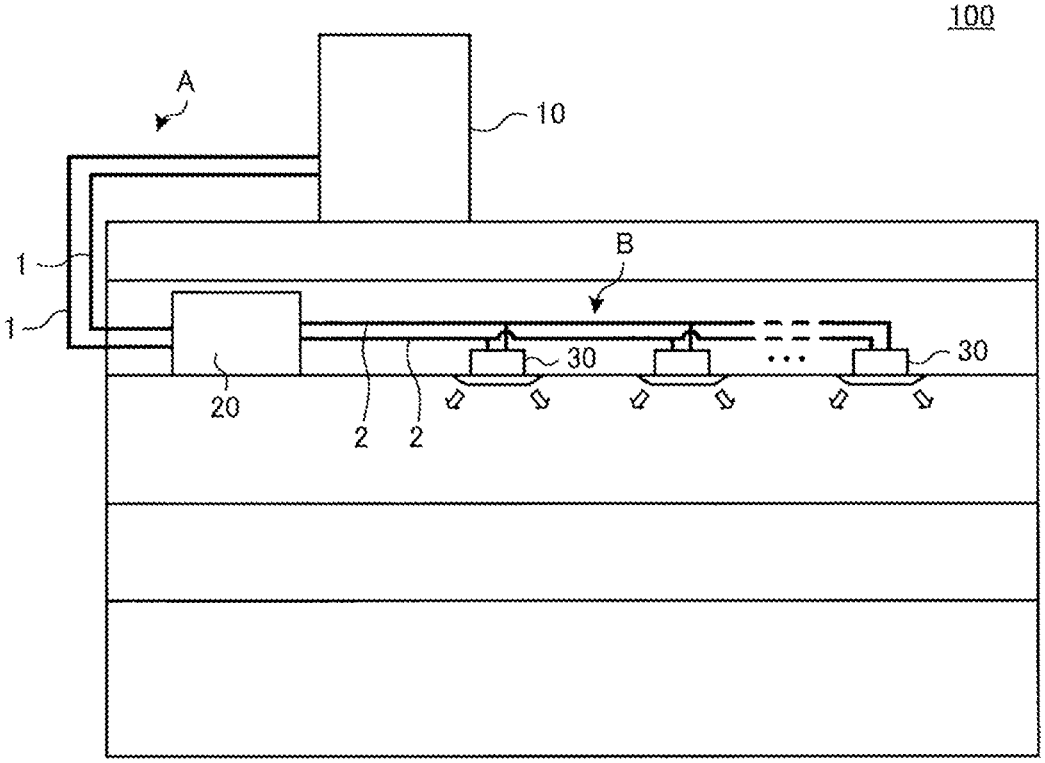
FIG. 1 is a schematic view of an example of installation of an air-conditioning apparatus according to Embodiment 1 of the present disclosure.

An air-conditioning apparatus according to Embodiment 1 will be described with reference to the drawings. In each of the figures in the drawings, components that are the same as or equivalent to those in a previous figure or figures are denoted by the same reference signs. In each of the figures, a relationship in size between components may be different from an actual one. Configurations of components as described in the entire text of the specification are examples. That is, the configurations of the components are not limited to those as described in the specification.

[Example of Installation of Air-Conditioning Apparatus 100]

FIG. 1 is a schematic view of installation of an air-conditioning apparatus 100 of Embodiment 1 of the present disclosure. As illustrated in FIG. 1, the air-conditioning apparatus 100 includes a refrigerant cycle circuit A in which refrigerant circulates, and a heat medium circulation circuit B in which heat is received and transferred and a heat medium, such as water, which does not change in phase in a use temperature range, circulates. Furthermore, the air-conditioning apparatus 100 perform cooling, heating, or other operations to condition air in an indoor space that is an air-conditioned space.

The air-conditioning apparatus 100 includes an outdoor unit 10 serving as a heat source unit and a plurality of indoor units 30, 30, . . . , and a relay unit 20 through which heat is transferred between the refrigerant that circulates in the refrigerant cycle circuit A and the heat medium that circulates in the heat medium circulation circuit B. The outdoor unit 10 and the relay unit 20 are connected by a refrigerant pipe 1, thereby forming the refrigerant cycle circuit A in which the refrigerant circulates in the refrigerant pipe 1. Furthermore, the relay unit 20 and the plurality of indoor units 30, 30, . . . , are connected by heat medium pipes 2, thereby forming the heat medium circulation circuit B in which the heat medium circulates in the heat medium pipes 2.

It should be noted that the number of outdoor units 10, the number of relay units 20 and the number of indoor units are not limited to those of the above example. For example, it may be set that a plurality of outdoor units 10 are provided, a plurality of relay units 20 the number of which is equal to that of the outdoor units 10 are provided, and the outdoor units 10 are connected to the respective relay units 20. That is, the number of outdoor units 10, the number of relay units 20, and the number of indoor units 30 can be determined as appropriate depending the scale of a building, etc.

As the refrigerant that circulates in the refrigerant cycle circuit A, for example, a single-component refrigerant such as R-22 or R-134a, a near-azeotropic refrigerant mixture such as R-410A or R-404A, or a zeotropic refrigerant mixture such as R-407C is used. Furthermore, refrigerant having a double bond in the chemical formula and a relatively low global warming potential, such as $CF_3CF{=}CH_2$, a mixture containing the refrigerant, or natural refrigerant, such as $CO_2$ or propane, is used. As the heat medium that circulates in the heat medium circulation circuit B, for example, brine (antifreeze liquid) or water, or a mixture of brine and water is used.

[Configuration of Air-Conditioning Apparatus 100]

Figure 2:
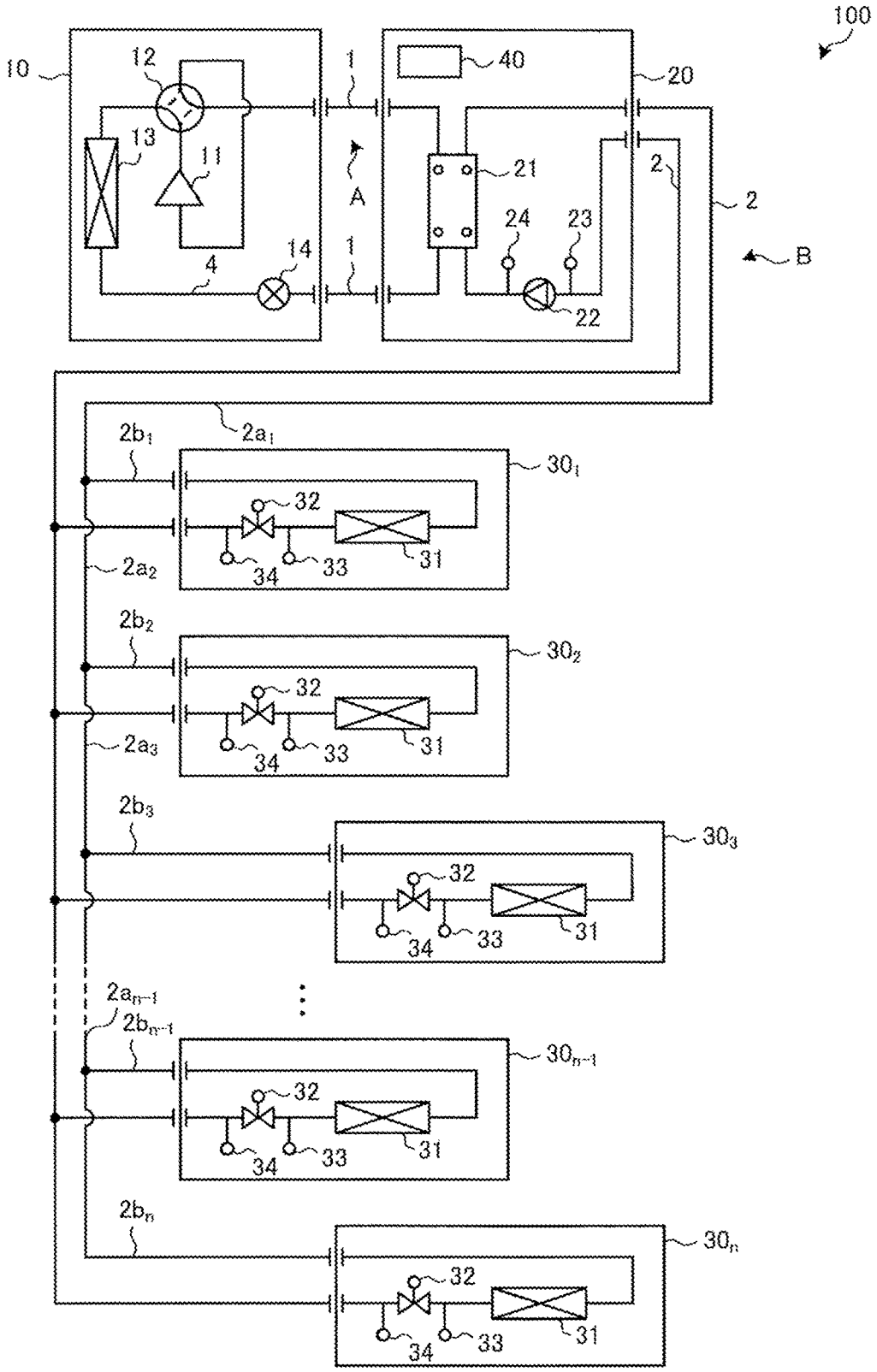
FIG. 2 is a schematic view of an example of the configuration of the air-conditioning apparatus according to Embodiment 1 of the present disclosure

FIG. 2 is a schematic view of an example of the configuration of the air-conditioning apparatus 100 according to Embodiment 1 of the present disclosure. As illustrated in FIG. 2, the air-conditioning apparatus 100 includes the outdoor unit 10, the relay unit 20, which is an example of a heat-medium transfer device, indoor units $\mathbf{30}_1$, $\mathbf{30}_2$, $\mathbf{30}_3$, . . . , $\mathbf{30}_{n-1}$, and $\mathbf{30}_n$, and a controller 40. In this example, the controller 40 is provided in the relay unit 20.

It should be noted that in the following description, the indoor units $\mathbf{30}_1$, $\mathbf{30}_2$, $\mathbf{30}_3$, . . . , $\mathbf{30}_{n-1}$, and $\mathbf{30}_n$ may be collectively referred to as indoor units $\mathbf{30}_k$, and k means integers from 1 to n. The location of the controller 40 is not limited to that of the above example. That is the controller 40 may be provided in the outdoor unit 10 or any of the plurality of indoor units $\mathbf{30}_k$, or may be provided separate from those units. The following description is made with respect to the case where the outdoor unit 10 and the heat-medium transfer unit are provided as separate units. However, this is not limiting. For example, the outdoor unit 10 and the heat-medium transfer unit may be provided as a single unit.

(Heat Medium Pipe 2)

Heat medium pipes 2 include: main pipes 2*a* that are connected to the relay unit 20; and branch pipes $\mathbf{2}b_1$, $\mathbf{2}b_2$, $\mathbf{2}b_3$, . . . , $\mathbf{2}b_{n-1}$, and $\mathbf{2}b_n$ that branch off from the main pipes 2*a* and are connected to the respective indoor units $\mathbf{30}_k$. In Embodiment 1, of the main pipes 2*a*, a main pipe 2*a* that extends from the relay unit 20 to a branch point from which the branch pipe $\mathbf{2}b_1$ extends to the indoor unit $\mathbf{30}_1$ will be referred to as "main pipe $\mathbf{2}a_1$". Furthermore, of the main pipes 2*a*, a main pipe 2*a* that extend from a branch point for an indoor unit $\mathbf{30}_{k-1}$ to a branch point for an indoor unit $\mathbf{30}_k$ will be referred to as "main pipe $\mathbf{2}a_k$".

It should be noted that since a pipe that extends from a branch point from which a branch pipe extends to an indoor unit $\mathbf{30}_{n-1}$ to the last indoor unit that is an indoor unit $\mathbf{3}_n$ is a branch pipe $\mathbf{2}b_n$, no main pipe $\mathbf{2}a_n$ is present from the branch point to the indoor unit $\mathbf{3}_n$, and in the following description, the main pipes $\mathbf{2}a_1$ to $\mathbf{2}a_{n-1}$ may be correctively referred to as "main pipe $\mathbf{2}a_k$"

(Outdoor Unit 10)

The outdoor unit 10 includes a compressor 11, a refrigerant flow switching unit 12, an outdoor heat exchanger 13, and an expansion device 14. The compressor 11, the refrigerant flow switching unit 12, the outdoor heat exchanger 13, a refrigerant-side flow passage of a heat-medium heat exchanger 21 (which will be descried later) provided in the relay unit 20, and the refrigerant pipe 1 are sequentially connected by refrigerant pipes 1.

The compressor 11 sucks low-temperature and low-pressure refrigerant, compresses the low-temperature and low-pressure refrigerant into high-temperature and high pressure refrigerant, and discharges the high-temperature and high pressure refrigerant. The compressor 11 is, for example, an inverter compressor whose operation frequency is changed, whereby the capacity of the compressor that is the amount of refrigerant that the compressor discharges per unit time is controlled. The operation frequency of the compressor 11 is controlled by the controller 40, which will be described later.

The refrigerant flow switching unit 12 is, for example, a four-way valve, and switches the flow direction of the refrigerant to switch the operation to be performed between a cooling operation and a heating operation. At the time of performing the cooling operation, the refrigerant flow switching unit 12 switches the flow direction of the refrigerant such that a discharge side of the compressor 11 and the outdoor heat exchanger 13 are connected with each other as indicated by a solid line in FIG. 2. At the time of performing the heating operation, the refrigerant flow switching unit 12 switches the flow direction of the refrigerant such that the discharge side of the compressor 11 and the relay unit 20 are connected with each other as indicated by a broken line in FIG. 2. The switching of the flow direction of the refrigerant by the refrigerant flow switching unit 12 is controlled by the controller 40.

The outdoor heat exchanger 13 causes heat exchange to be performed between the refrigerant and outdoor air supplied by a fan not illustrated. During the cooling operation, the outdoor heat exchanger 13 operates as a condenser that transfers heat of the refrigerant to the outdoor air to condense the refrigerant. During the heating operation, the outdoor heat exchanger 13 operates as an evaporator that evaporates the refrigerant to cool the outdoor air with the heat of evaporation that is generated at that time.

The expansion device 14 is, for example, an expansion valve, and expands the refrigerant. The expansion device 14 is a valve whose opening value can be controlled, such as an electronic expansion valve. The opening degree of the expansion device 14 is controlled by the controller 40.

(Relay Unit 20)

The relay unit 20 includes the heat-medium heat exchanger 21 and a pump 22. The heat-medium heat exchanger 21 operates as a condenser or an evaporator, and causes heat exchange to be performed between the refrigerant that flows in the refrigerant cycle circuit A connected with the refrigerant-side flow passage and a heat medium that flows in the heat medium circulation circuit B connected with a heat-medium side flow passage. During the cooling operation, the heat-medium heat exchanger 21 operates as the evaporator that evaporates the refrigerant to cool the heat medium with the heat of evaporation that is generated when the refrigerant is evaporated, and during the heating operation, the heat-medium heat exchanger 21 operates as the condenser that transfers heat of the refrigerant to the heat medium to condense the refrigerant.

The pump 22 is driven by a motor not illustrated, to transfer and circulate the heat medium that flows in the heat medium pipe 2. The pump 22 is, for example, a pump whose capacity can be controlled, and can adjust the flow rate of the heat medium for each of the plurality of indoor units 30*k*, depending on the load of each of the plurality of indoor units 30*k*. Driving of the pump 22 is controlled by the controller 40. To be more specific, the pump 22 is controlled such that the higher the load, the higher the flow rate of the heat medium, and the lower the load, the lower the flow rate of the heat medium.

The relay unit 20 includes a pump-inlet pressure sensor 23 and a pump-outlet pressure sensor 24. The pump-inlet pressure sensor 23 is provided on an inlet side of the pump 22 for the heat medium, and detects a pressure Pp1 of the heat medium that will flow into the pump 22. The pump-outlet pressure sensor 24 is provided on an outlet side of the pump 22 for the heat medium, and detects a pressure Pp2 of the heat medium that has been discharged from the pump 22.

(Indoor Unit $\mathbf{30}_k$)

The plurality of indoor units $\mathbf{30}_k$ are connected to respective branch pipes $\mathbf{2}b_k$ that branch off from the main pipes $\mathbf{2}a_k$. As a result, the plurality of indoor units $\mathbf{30}_k$ are connected in parallel with the relay unit 20. The plurality of indoor units $\mathbf{30}_k$ each include an indoor heat exchanger 31 and a flow control valve 32. The pump 22 and the heat-medium side flow passage of the heat medium heat exchanger 21 that are provided in the relay unit 20, the indoor heat exchanger 31, and the flow control valve 32 are sequentially connected by heat medium pipes 2 to form the heat medium circulation circuit B.

The indoor heat exchanger 31 causes heat exchange to be performed between the heat medium and indoor air supplied by a fan not illustrated. As a result, air for cooling or air for heating is generated as conditioned air to be supplied to the indoor space. The flow control valve 32 adjusts the flow rate of the heat medium that flows through the indoor heat exchanger 31. An opening-degree control range of the flow control valve 32 in each of the indoor units $\mathbf{30}_k$ is the range in which the opening degree of the flow control valve 32 is controlled. In each indoor unit $\mathbf{30}_k$, the opening-degree control range is determined. Also, the opening-degree control range is controlled by the controller 40. It should be noted that the opening-degree control range of the flow control valve 32 in each indoor unit $\mathbf{30}_k$ will be described later.

Each indoor unit $\mathbf{30}_k$ includes a valve-inlet pressure sensor 33 and the valve-outlet pressure sensor 34. The valve-inlet pressure sensor 33 is provided on an inlet side of the flow control valve 32 for the heat medium, and detects a pressure Pv1 of the heat medium that will flows into the flow control valve 32. The valve-outlet pressure sensor 34 is provided on an outlet side of the flow control valve 32 for the heat medium, and detects a pressure Pv2 of the heat medium that has flowed from the flow control valve 32.

(Controller 40)

The controller 40 controls the operation of the entire air-conditioning apparatus 100 including the outdoor unit 10, the relay unit 20, and the indoor units $\mathbf{30}_k$, based on various information received from various sensors provided at the units in the air-conditioning apparatus 100. In particular, in Embodiment 1, the controller 40 performs processing for determining the opening-degree control range of the flow control valve 32 in each of the indoor units $\mathbf{30}_k$.

Figure 3:
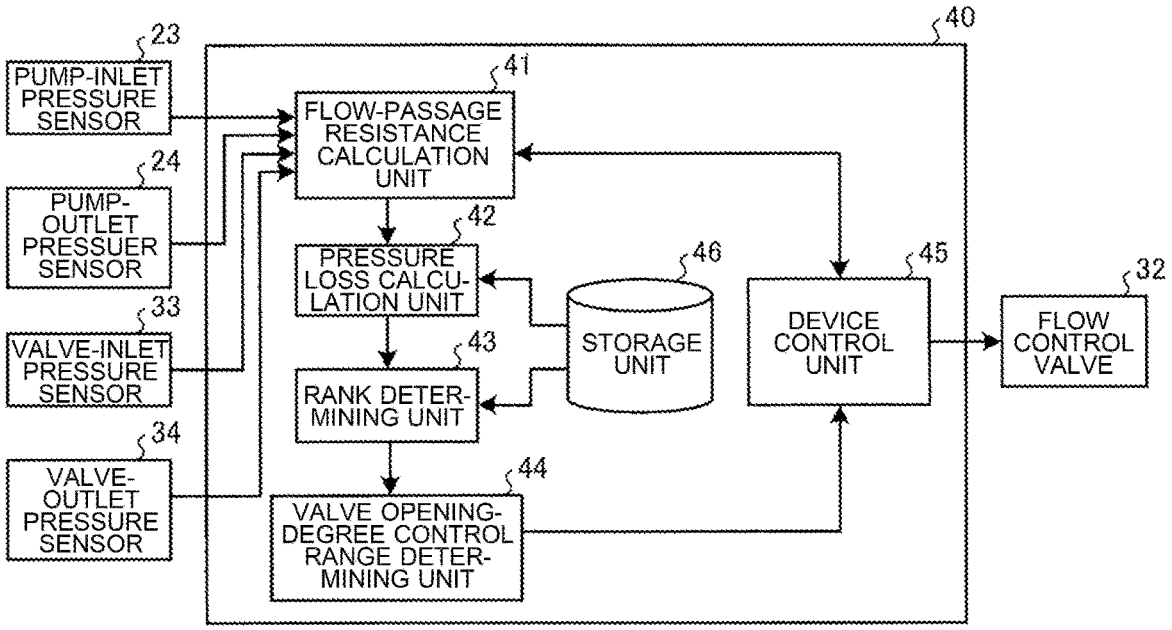
FIG. 3 is a functional block diagram of an example of the configuration of a control device as illustrated in FIG. 2.

FIG. 3 is a functional block diagram of an example of the configuration of the controller 40 as illustrated in FIG. 2. As illustrated in FIG. 3, the controller 40 includes a flow-passage resistance calculation unit 41, a pressure loss calculation unit 42, a rank determining unit 43, a valve opening-degree control range determining unit 44, a device control unit 45, and a storage unit 46. The controller 40 has functions that are fulfilled by executing software on an arithmetic device such as a microcomputer, or is made of, for example, hardware such as a circuit device that fulfills the functions.

The flow-passage resistance calculation unit 41 calculates a flow-passage resistance $Ra_k$ in the main pipe $\mathbf{2}a_k$ for each of the indoor units $\mathbf{30}_k$ and a flow-passage resistance $Rb_k$ in a branch pipe $\mathbf{2}b_k$ for each indoor unit $\mathbf{30}_k$ based on the results of detection by the pump-inlet pressure sensor 23, the pump-outlet pressure sensor 24, the valve-inlet pressure sensor 33, and the valve-outlet pressure sensor 34. The way of calculating each of the flow-passage resistances $Ra_k$ and $Rb_k$ will be specifically described later.

The pressure loss calculation unit 42 calculates a pressure loss $dPa_k$ in the main pipe $\mathbf{2}a_k$ based on the flow rate Vw of the heat medium and the flow-passage resistance $Ra_k$ in the main pipe $\mathbf{2}a_k$ that is calculated by the flow-passage resistance calculation unit 41. The pressure loss calculation unit 42 calculates a pressure loss $dPb_k$ in the branch pipe $2b_k$ based on the flow rate Vw of the heat medium and a flow-passage resistance $Rb_k$ in the branch pipe $2b_k$ that is calculated by the flow-passage resistance calculation unit 41. The way of calculating each of the pressure losses $dPa_k$ and $dPb_k$ will be specifically described later.

The rank determining unit 43 determines ranks of the pressure loss $dPa_k$ in the main pipe $2a_k$ and the pressure loss $dPb_k$ in the branch pipe $2b_k$ that are calculated by the pressure loss calculation unit 42, by referring to a first rank table and a second rank table that are stored in advance in the storage unit 46. The first rank table associates magnitudes of the pressure loss in the main pipe $2a_k$ with ranks each of which is indicated as "A_rank" that is the rank of the flow-passage resistance $Ra_k$. The second rank table associates magnitudes of the pressure loss $dPb_k$ in the branch pipe $2b_k$ with ranks each of which is indicated by "B_rank" that is the rank of flow-passage resistance $Rb_k$.

The valve opening-degree control range determining unit 44 determines the valve opening-degree control range of the flow control valve 32 in each of the indoor units $30_k$ based on the ranks of the flow-passage resistances $Ra_k$ and $Rb_k$ that are determined by the rank determining unit 43.

The device control unit 45 controls the outdoor unit 10, the relay unit 20, and the indoor units $30_k$ based on the results of processing by the units included in the controller 40. In particular, in Embodiment 1, when the valve opening-degree control range of the flow control valve 32 is determined, the device control unit 45 controls the pump 22 of the relay unit 20 and the flow control valve 32 of each of the indoor units $30_k$ in response to an instruction given from the flow-passage resistance calculation unit 41. Furthermore, when the air-conditioning apparatus 100 is in operation, the device control unit 45 controls the opening degree of the flow control valve 32 in the valve opening-degree control range determined by the valve opening-degree control range determining unit 44.

The storage unit 46 previously stores the flow rate Vw of the heat medium that is referred to by the pressure loss calculation unit 42 and the first rank table and the second rank table that are referred to by the rank determining unit 43.

Figure 4:
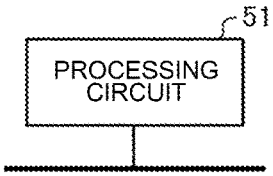
FIG. 4 is a hardware configuration diagram illustrating an example of the configuration of the control device as illustrated in FIG. 3.

FIG. 4 is a hardware configuration diagram illustrating an example of the configuration of the controller 40 as illustrated in FIG. 3. In the case where the various functions of the controller 40 are fulfilled by hardware, the controller 40 as illustrated in FIG. 3 is a processing circuit as illustrated in FIG. 4. The functions of the flow-passage resistance calculation unit 41, the pressure loss calculation unit 42, the rank determining unit 43, the valve opening-degree control range determining unit 44, the device control unit 45, and the storage unit 46 as illustrated in FIG. 3 are fulfilled by the processing circuit 51.

In the case where the functions are fulfilled by hardware, the processing circuit 51 is, for example, a single circuit, a composite circuit, a programmed processor, a parallel programmed circuit, an application specific integrated circuit (ASIC), a field-programmable gate array (FRGA), or a combination of these circuits. The functions of the flow-passage resistance calculation unit 41, the pressure loss calculation unit 42, the rank determining unit 43, the valve opening-degree control range determining unit 44, the device control unit 45, and the storage unit 46 may be fulfilled by respective processing circuits 51 or a single processing circuit 51.

Figure 5:
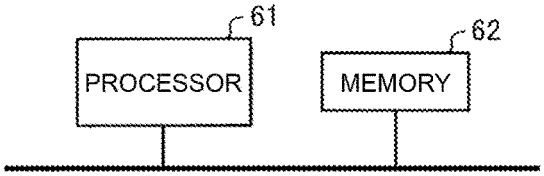
FIG. 5 is a hardware configuration diagram of another example of the configuration of the control device as illustrated in FIG. 3.

FIG. 5 is a hardware configuration diagram of another example of the configuration of the controller 40 as illustrated in FIG. 3. In the case where the functions of the controller 40 are fulfilled by software, the controller 40 as illustrated in FIG. 3 includes a processor 61 and a memory 62 as illustrated in FIG. 5. The functions of the flow-passage resistance calculation unit 41, the pressure loss calculation unit 42, the rank determining unit 43, the valve opening-degree control range determining unit 44, the device control unit 45, and the storage unit 46 as illustrated in FIG. 3 are fulfilled by the processor 61 and the memory 62.

In the case where the functions are fulfilled by software, the functions of the flow-passage resistance calculation unit 41, the pressure loss calculation unit 42, the rank determining unit 43, the valve opening-degree control range determining unit 44, and the device control unit 45 are fulfilled by software, firmware, or a combination of software and firmware. The software and the firmware are described as programs and stored in the memory 62. The processor 61 reads the programs stored in the memory 62 and executes the programs to fulfill the functions of the above units.

As the memory 62, a nonvolatile or volatile semiconductor memory such as a random access memory (RAM), a read-only memory (ROM), a flash memory, an erasable and programmable ROM (EPROM), or an electrically erasable and programmable ROM (EEPROM) is used. Alternatively, as the memory 62, a removable storage medium such as a magnetic disc, a flexible disc, an optical disc, a compact disc (CD), a minidisc (MD), or a digital versatile disc (DVD) may be used.

[Operation of Air-Conditioning Apparatus 100]

An operation of the air-conditioning apparatus 100 according to Embodiment 1 will be described. The following description is made with respect to the flow of the heat medium that flows in the heat medium circulation circuit B and processing for determining the valve opening-degree control range of the flow control valve 32 in each of the indoor units 30*k*.

[Flow of Heat Medium]

The flow of the heat medium in the air-conditioning apparatus 100 will be described with reference to FIG. 1. In the relay unit 20, the heat medium transferred from the pump 22 flows into the heat-medium heat exchanger 21. The heat medium that has flowed into the heat-medium heat exchanger 21 exchanges heat with refrigerant that flows in the refrigerant-side flow passage to transfer heat to the refrigerant or absorb heat from the refrigerant, and then flows out of the heat-medium heat exchanger 21. The heat medium that has flowed out of the heat-medium heat exchanger 21 flows out of the relay unit 20, and flows into the indoor units $30_k$ through the main pipes $2a_k$ and the branch pipes $2b_k$ of the heat medium pipes 2.

The heat medium that has flowed into each of the indoor units $30_k$ flows into the indoor heat exchanger 31. The heat medium that has flowed into the indoor heat exchanger 31 exchanges heat with an indoor air to absorb heat from the indoor air or transfer heat to the indoor air, thereby cooling or heating the indoor air, and then flows out of the indoor heat exchanger 31. The heat medium that has flowed of the indoor heat exchanger 31 flows out of the associated indoor unit $3_k$, with the flow rate of the heat medium adjusted by the flow control valve 32.

The heat mediums that have flowed out of the indoor units $30_k$ join each other in the heat medium pipes 2, and then flow into the relay unit 20. The heat medium that has flowed into the relay unit 20 flows into the pump 22. The above circulation of the heat medium between the relay unit 20 and each of the indoor units 30*k* is repeated.

(Flow-Passage Resistance Depending on Pipe Length)

The heat medium pipes 2 that are connected from the indoor units 30*k* to the relay unit 20 have different lengths, since for example, the positions of the indoor units $\mathbf{30}_k$ are different from each other. As a result, the pressure losses in the heat medium pipes 2 are different from each other since the flow-passage resistances in the heat medium pipes 2 are different from other. Accordingly, the capacities of the indoor units $\mathbf{30}_k$ are also different from each other.

In such a case, when the indoor units $\mathbf{30}_k$ are operated, with the opening-degree control ranges of the control valves 32 of the indoor units $\mathbf{30}_k$ set equal to each other, the indoor units $\mathbf{30}_k$ cannot be operated with the same capacity. To be more specific, the capacity of an indoor unit 30 located far from the relay unit 20 is lower than that of an indoor unit 30 located close to the relay unit 20, since the heat medium pipe 2 connected to the indoor unit 30 far from the relay unit 20 is longer than that connected to the indoor unit 30 close to the relay unit 20.

In view of the above, in Embodiment 1, in the case where the heat medium pipes 2 connected to the indoor units $\mathbf{30}_k$ have different lengths, the opening-degree control ranges of the flow control valve 32 in the indoor units $\mathbf{30}_k$ are determined depending on the pressure losses depending on the pipe lengths in order to eliminate the difference in capacity between the indoor units 30*k*.

Figure 6:
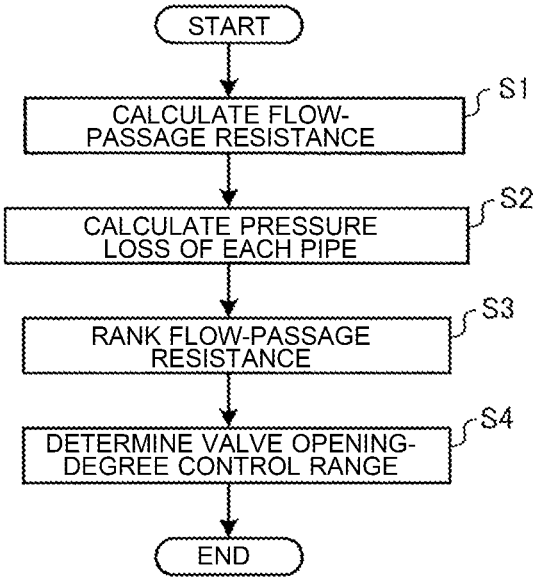
FIG. 6 is a flowchart of an example of the flow of processing for determining a valve opening-degree control range in the air-conditioning apparatus according to Embodiment 1.

FIG. 6 is a flowchart of an example of the flow of the processing for determining the valve opening-degree control range in the air-conditioning apparatus 100 according to Embodiment 1. The processing indicated by the flowchart of FIG. 6 is performed in consideration of the lengths of the heat medium pipes 2 when the air-conditioning apparatus 100 is installed. It should be noted that in consideration of a change in the flow-passage resistance that is made with the passage of time, the processing for determining the valve opening-degree control range may be periodically performed when the air-conditioning apparatus is in the stopped state, for example, on weekends or at midnight, such that the valve opening-degree control range can be corrected.

First, in step S1, the flow-passage resistance calculation unit 41 calculates the flow-passage resistance $Ra_k$ in each of the main pipes $\mathbf{2}a_k$ of the heat medium pipes 2 and the flow-passage resistance $Rb_k$ in each of the branch pipes $\mathbf{2}b_k$ of the heat medium pipes 2. The flow-passage resistances $Ra_k$ and $Rb_k$ are flow-passage resistances in a main pipe $\mathbf{2}a_k$ and a branch pipe $\mathbf{2}b_k$ that are located to extend from the outlet of the pump 22 in the relay unit 20 to the inlet of the flow control valve 32 in an associated indoor unit $\mathbf{30}_k$.

In general, the flow-passage resistance R of a heat medium pipe 2 can be calculated based on the following equation (1) using the pressure difference dP for the heat medium pipe 2 and the flow rate Vw of the heat medium.

$$dP=R\times Vw^2 \tag{1}$$

The pressure difference dP is the difference between the result Pp2 of detection by the pump-outlet pressure sensor 24 and the result Pv1 of detection by the valve-inlet pressure sensor 33. The flow rate Vw of the heat medium can be measured by, for example, a flowmeter. The measured flow rate Vw is stored in the storage unit 46. It should be noted that the way of obtaining the flow rate Vw is not limited to that of the above example. For example, the flow rate Vw may be calculated based on an instruction value for the pump 22, the difference in pressure between the inlet and outlet of the pump 22 and data regarding the pump 22 that is obtained by measurement performed in advance.

It should be noted that the results of detection by various sensors that detect respective pressures may have an inherent error that occurs at a measuring instrument and an error that is caused by the difference between the levels of devices that have been set. It is therefore necessary to correct those errors when calculating the pressure difference d. In view of this point, in Embodiment 1, pressure sensors are calibrated with reference to a value that is obtained by a given pressure sensor. In this example, the pressure sensors are calibrated with reference to a pressure Pp1 that is the result of detection by the pump-inlet pressure sensor 23.

In this case, in step S1, the device control unit 45 stops the pump 22, and also causes the flow control valves 32 of all the indoor units $\mathbf{30}_k$ to be opened. The flow-passage resistance calculation unit 41 calculates a calibration value ΔP (=Pv1−Pp1) that is the difference between the result Pv1 of detection by the valve-inlet pressure sensor 33 that is used to calculate the pressure difference dP and the result Pp1 of detection by the pump-inlet pressure sensor 23.

Next, the flow-passage resistance calculation unit 41 calculates the pressure difference dP between the result Pp2 of detection by the pump-outlet pressure sensor 24 and the result Pv1 of detection by the valve-inlet pressure sensor 33, and then subtracts the above calculated calibration value ΔP from the pressure difference d. As a result, the pressure difference dP in which the error is corrected is calculated.

It should be noted that in the case of calculating the flow-passage resistances $Ra_k$ and $Rb_k$ in the main pipes $\mathbf{2}a_k$ and branch pipes $\mathbf{2}b_k$ that are connected to the respective indoor units $\mathbf{30}_k$, the device control unit 45 causes the indoor units $\mathbf{30}_k$ to successively operate one by one from a state in which all the indoor units $\mathbf{30}_k$ are in the stopped state. Then, after causing all the indoor units $\mathbf{30}_k$ to operate, the device control unit 45 stop the indoor units $\mathbf{30}_k$ successively one by one. With respect to each of the indoor units $\mathbf{30}_k$, the flow-passage resistance calculation unit 41 calculates the pressure difference dP between the pressure detected in the case where the indoor unit $\mathbf{30}_k$ is in operation and that in the case where the indoor unit indoor units $\mathbf{30}_k$ is in the stopped state. As a result, it is possible to obtain the flow-passage resistances $Ra_k$ and $Rb_k$ in the main pipe $\mathbf{2}a_k$ and the branch pipe $\mathbf{2}b_k$ of the heat medium pipe 2 that are connected to the above each indoor unit $\mathbf{30}_k$.

Next, in step S, the pressure loss calculation unit 42 calculates a pressure loss $dPa_k$ in the main pipe $\mathbf{2}a_k$ based on the flow-passage resistance $Ra_k$ and the flow rate Vw of the heat medium. Also, the pressure loss calculation unit 42 calculates a pressure loss $dPb_k$ in the branch pipe $\mathbf{2}b_k$ based on the flow-passage resistance $Rb_k$ and the flow rate Vw of the heat medium.

The pressure loss $dPa_k$ in the main pipe $\mathbf{2}a_k$ is calculated according to the following equation (2) using the flow-passage resistance $Ra_k$ in the main pipe $\mathbf{2}a_k$ that is calculated in step S1 and the flow rate Vw obtained in advance. Furthermore, the pressure loss $dPb_k$ in the branch pipe $\mathbf{2}b_k$ is calculated according to the following equation (3) using the flow-passage resistance $Rb_k$ in the branch pipe $\mathbf{2}b_k$ that is calculated in step S1 and the flow rate Vw.

$$dPa_k=Ra_k\times Vw^2 \tag{2}$$

$$dPb_k=Rb_k\times Vw^2 \tag{3}$$

It should be noted that the pressure losses $dPa_k$ and $dPb_k$ obtained according to the equations (2) and (3) are values depending on the flow rate Vw, and can be considered to have a measurement error for the flow rate Vw. Therefore, the pressure losses $dPa_k$ and $dPb_k$ may be converted to, as normalized values, pressure losses in the case where the heat medium flows at a rated flow rate.

Next, in step S3, the rank determining unit 43 ranks the pressure loss $dPa_k$ in the main pipes $2a_k$ and the pressure loss $dPb_k$ in the branch pipe $2b_k$ using the first rank table and the second rank table that are stored in the storage unit 46 in advance.

FIG. 7 is a schematic view showing an example of the first rank table. FIG. 8 is a schematic view showing an example of the second rank table. The first rank table, as indicated in FIG. 7, associates ranges of the magnitudes of the pressure loss $dPa_k$ in the main pipe $2a_k$ with ranks that are indicated in "A_rank" and indicate respective magnitudes of the flow-passage resistance $Ra_k$. To be more specific, in the first rank table, ranks indicated in the rank A_rank are associated with respective ranges of the magnitudes of the pressure loss $dPa_k$. The second rank table, as indicated in FIG. 8, associates ranges of the magnitudes of the pressure loss $dPb_k$ of the branch pipe $2b_k$ with ranks that are indicated in "B_rank" and indicate respective magnitudes of the flow-passage resistance $Rb_k$. In the second rank table, the ranks indicated in the B_rank are associated with respective ranges of the magnitudes of the pressure loss $dPb_k$. It should be noted that the first rank table and the second rank table of this example use values into which the pressure losses $dPa_k$ and $dPb_k$ are converted in step S2 as normalized values in the case where the heat medium flows at the rated flow rate.

In this example, in the first rank table and the second rank table, for each of the ranks, the range of each of the pressure losses $dPa_k$ and $dPb_k$ is set to 10 [kPa]. For example, in the case where the pressure loss $dPa_k$ in the main pipe $2a_k$ that is calculated in step S2 is 10 [kPa], the flow-passage resistance $Ra_k$ is ranked "rank 1" based on the first rank table. In the case where the pressure loss $dPb_k$ in the branch pipe $2b_k$ is 35 [kPa], the low-passage resistance $Rb_k$ is ranked "rank 4" based on the second rank table. It should be noted that the ranges of the pressure loss in the first rank table and the second rank table are determined in advance depending on, for example, the lengths of the heat medium pipes 2 and the size of the air-conditioning apparatus 100. To be more specific, the ranges of the pressure loss that can beset depending on the lengths of the heat medium pipes 2 may be equally divided by the number of ranks that is determined in advance, and the divided ranges of the pressure loss may be associated with the respective ranks.

The rank determining unit 43 determines the rank A_rank of the pressure loss $dPa_k$ calculated in step S3 by referring to the first rank table stored in the storage unit 46. Furthermore, the rank determining unit 43 determines the rank B_rank of the pressure loss $dPb_k$ calculated in step S3 by referring to the second rank table stored in the storage unit 46.

Next, in step S4 as indicated in FIG. 6, the valve opening-degree control range determining unit 44 determines the valve opening-degree control range of the first control valve 32 in each of the indoor units $30_k$. It should be noted that for example, with respect to each indoor unit $30_k$, the maximum opening degree of the flow control valve 32 is determined in proportion to the capacity of the indoor unit $30_k$, whereby the valve opening-degree control range is determined in advance for the indoor unit $30_k$.

In step S4, the valve opening-degree control range determining unit 44 corrects the valve opening-degree control range determined in advance, based on the A_rank and B_rank of the flow-passage resistances $Ra_k$ and $Rb_k$ ranked in step S3.

More specifically, in the correction, the valve opening-degree control range determining unit 44 reduces the maximum opening degree such that the smaller the total of the A_rank and B_rank for the main pipe $2a_k$ and branch pipe $2b_k$ connected to each indoor unit $30_k$, the smaller the valve opening-degree control range of the flow control valve 32. As a result, the device control unit 45 can control the opening value of the flow control valve 32 in each indoor unit $30_k$ in the corrected valve opening-degree control range when the air-conditioning apparatus 100 is operated.

In the case where the flow-passage resistances are calculated in detail, and the valve opening-degree control range is determined based on the calculated flow-passage resistances, there is a possibility that the load required to calculate the flow-passage resistance will be high and the control will be complicated. Furthermore, in the case where the calculated flow-passage resistances have errors, there is a possibility that further errors will be added to the errors, that is, accumulation of the errors will occur, and the total of the errors will be greater. By contrast, in Embodiment 1, the flow-passage resistances are ranked depending on the pressure losses, and the valve opening-degree control range is determined based on those ranks, whereby it is possible to reduce complication of the control and prevent accumulation of errors.

As described above, in the air-conditioning apparatus 100 according to Embodiment 1, the valve opening-degree control ranges of the flow control valves 32 are determined based on the flow-passage resistances depending the lengths of the heat medium pipes 2 connected to the indoor units $30_k$ such that the smaller the flow-passage resistance, the smaller the valve opening-degree control range. Thus, even in the case where the pipes connected to the indoor units $30_k$ have different lengths, the flow rates of heat mediums that flow in the indoor heat exchangers 31 in the indoor units $30_k$ are uniformized, and the difference between the capacities of the indoor units $30_k$ can thus be eliminated.

In the air-conditioning apparatus 100, the flow-passage resistance calculation unit 41 calculates the flow-passage resistances of the heat medium pipes 2 connected to each of the indoor units $30_k$, based on the difference between pressures Pp2 and Pv1 that are detected by the pump-outlet pressure sensor 24 and the associated valve-inlet pressure sensor 33. Because of use of the flow-passage resistances calculated in such a manner, the relay unit 20 can obtain the pressure loss in each of the heat medium pipes 2 connected to the indoor units $30_k$.

In the air-conditioning apparatus 100, the flow-passage resistance calculation unit 41 calculates the pressure difference based on the result of detection by the valve-inlet pressure sensor 33 calibrated with reference to the result of detection by the pump-inlet pressure sensor 23. Therefore, since the above sensor is calibrated as described above, an error in the calculated pressure difference, etc., can be corrected.

In the air-conditioning apparatus 100, the valve opening-degree control range of the flow control valve 32 is determined based on the rank of the flow-passage resistance that is determined, by referring to the table stored in the storage unit 46, based on the calculated pressure loss. It is therefore possible to reduce complication of processing that is performed in the determination of the valve opening-degree control range, while preventing accumulation of errors in the detailed calculation of the flow-passage resistance. It should be noted that in the case of calculating the pressure loss, it is appropriate that the pressure loss is converted to, as a normalized value, a pressure loss in the case where the heat medium flows at a rated flow rate, in order to reduce the influence of a measurement error on the flow rate of the heat medium.

In the air-conditioning apparatus 100, in the case where the valve opening-degree control range is determined, the maximum value of the valve-opening degree is reduced based on the rank such that the lower the rank, the smaller the valve opening-degree control range. As a result, the closer the indoor unit $\mathbf{30}_k$ to the relay unit 20 and the shorter the heat medium pipe 2, the smaller the maximum value of the opening degree of the flow control valve 32, whereby the capacities of the indoor units $\mathbf{30}_k$ connected to the relay unit 20 can be uniformized.

As the result of the above calculation of the flow-passage resistance, when it is determined that a lifting height and a flow rate that can be achieved by the pump 22 cannot be ensured, it is conceivable that pipes at an actual place are too long, pipes are erroneously connected, or a pipe or pipes are not connected. In such a case, an alarm is given to enable a better test operation to be performed.

Although the above description is made with respect to Embodiment 1, it is not limiting. That is, various modification and applications can be applied without departing from the subject matter of the present disclosure. In Embodiment 1, the flow-passage resistances $Ra_k$ and $Rb_k$ are obtained based on the lengths of the heat medium pipes 2 that extend from the outlet of the pump 22 to the inlet of the flow control valve 32. However, this is not limiting. For example, the flow-passage resistances $Ra_k$ and $Rb_k$ may be acquired based on the lengths of heat medium pipes 2 that extend from the outlet of the flow control valve 32 to the inlet of the pump 22. This is because it is conceivable that the lengths of the heat medium pipes 2 from the outlet of the flow control valve 32 of the indoor unit $\mathbf{30}_k$ to the inlet of the pump 22 is equivalent to the lengths of the heat medium pipes 2 from the outlet of the pump 22 to the inlet of the flow control valve 32.

REFERENCE SIGNS LIST

1 refrigerant pipe, 2 heat medium pipe, $\mathbf{2}a$, $\mathbf{2}a_1$, $\mathbf{2}a_2$, $\mathbf{2}a_3$, . . . , $\mathbf{2}a_{n-1}$, $\mathbf{2}a_k$ main pipe, $\mathbf{2}b_1$, $\mathbf{2}b_2$, $\mathbf{2}b_3$, . . . , $\mathbf{2}b_{n-1}$, $\mathbf{2}b_n$, $\mathbf{2}b_k$ branch pipe, 10 outdoor unit, 11 compressor, 12 refrigerant flow switching device 13 outdoor heat exchanger, 14 expansion device, 20 relay unit, 21 heat-medium heat exchanger, 22 pump, 23 pump-inlet pressure sensor, 24 pump-outlet pressure sensor, 30, $\mathbf{30}_1$, $\mathbf{30}_2$, $\mathbf{30}_3$, . . . , $\mathbf{30}_{n-1}$, $\mathbf{30}_n$, $\mathbf{30}_k$ outdoor unit, 31 indoor heat exchanger, 32 flow control valve, 33 valve-inlet pressure sensor, 34 valve-outlet pressure sensor, 40 controller, 41 flow-passage resistance calculation unit, 42 pressure loss calculation unit, 43 rank determining unit, 44 valve opening-degree control range determining unit, 45 device control unit 46 storage unit, 51 processing circuit, 61 processor, 62 memory, 100 air-conditioning apparatus

The invention claimed is:

1. An air-conditioning apparatus comprising:

a relay unit, including a pump configured to circulate a heat medium that contains water or brine, the relay unit facilitating transfer of heat from the heat medium to a refrigerant flowing in the relay unit;

a plurality of indoor units, each of which includes an indoor heat exchanger configured to cause heat exchange to be performed between indoor air and the heat medium, and a flow control valve configured to adjust a flow rate of the heat medium that flows through each respective indoor heat exchanger, the plurality of indoor units being connected to the relay unit by respective heat medium pipes; and a controller configured to control an opening degree of the flow control valve of each respective indoor unit, wherein the controller is configured to determine a valve opening-degree control range of each respective flow control valve, which is a control range of an opening degree of the flow control valve of each respective indoor unit, based on a flow-passage resistance depending on a length of a pipe that extends from the relay unit to each respective indoor unit, such that the lower the flow-passage resistance, the smaller the valve opening-degree control range.

2. The air-conditioning apparatus of claim 1, wherein the relay unit includes a pump-outlet pressure sensor configured to detect a pressure of the heat medium on an outlet side of the pump, each of the plurality of indoor units further includes a valve-inlet pressure sensor configured to detect a pressure of the heat medium on an inlet side of the flow control valve of each respective indoor unit, and the controller is configured to calculate the flow-passage resistance in the heat medium pipe connected to each respective indoor unit, based on a pressure difference that is a difference between the pressures of the heat medium detected by the pump-outlet pressure sensor and the valve-inlet pressure sensor of each respective indoor unit.

3. The air-conditioning apparatus of claim 2, wherein the relay unit further includes a pump-inlet pressure sensor configured to detect a pressure of the heat medium on an inlet side of the pump, and the controller is configured to calculate the pressure difference, using a result of detection by the valve-inlet pressure sensor calibrated with reference to a result of detection by the pump-inlet pressure sensor.

4. The air-conditioning apparatus of claim 1, wherein the controller is configured to calculate a pressure loss in the heat medium pipe connected to each respective indoor unit, based on the flow-passage resistance to each respective indoor unit, store a table that associates ranges of the pressure loss and ranks with each other, the ranks indicating magnitudes of the flow-passage resistances, determine a rank of the flow-passage resistance in the heat medium pipe connected to each respective indoor unit, by referring to the stored table, based on the calculated pressure loss, and determine the valve opening-degree control range of the flow control valve of each respective indoor unit, based on the determined rank of the flow-passage.

5. The air-conditioning apparatus of claim 4, wherein the controller is configured to reduce a maximum value of the opening degree of each respective flow control valve based on the rank of each respective indoor unit, such that the lower the rank, the smaller the valve opening degree control range.

6. The air-conditioning apparatus of claim 1, wherein the heat medium pipes include respective main pipes connected to relay unit and respective branch pipes that branch off from the main pipes, and that are connected to the plurality of indoor units.

7. The air-conditioning apparatus of claim 1, wherein the controller is configured to periodically calculate the flow-passage resistance to each respective indoor unit and correct the valve opening-degree control range of each respective flow control valve based on the calculated flow-passage resistance.

8. The air-conditioning apparatus of claim 1, wherein the controller is configured to give an alarm when any flow-passage resistance calculated by the controller is higher than or equal to a lifting height that is achieved by the pump.

* * * * *